US009199103B2

(12) United States Patent
Hetrich et al.

(10) Patent No.: US 9,199,103 B2
(45) Date of Patent: Dec. 1, 2015

(54) FALL PROTECTION ARRANGEMENT

(75) Inventors: Mitchell H. Hetrich, Greenville, PA (US); David J. Losos, Evans City, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 343 days.

(21) Appl. No.: 13/103,414

(22) Filed: May 9, 2011

(65) Prior Publication Data

US 2011/0278095 A1 Nov. 17, 2011

Related U.S. Application Data

(60) Provisional application No. 61/333,984, filed on May 12, 2010.

(51) Int. Cl.
*A62B 1/10* (2006.01)
*A62B 35/00* (2006.01)

(52) U.S. Cl.
CPC ..... *A62B 1/10* (2013.01); *A62B 35/0093* (2013.01)

(58) Field of Classification Search
CPC ..... A62B 1/08; A62B 1/10; A62B 1/12; A62B 35/0093
USPC ..... 182/70, 71, 72, 73, 236, 237, 238, 239, 182/240, 3, 4, 231, 232, 234; 242/381, 396
See application file for complete search history.

(56) References Cited

U.S. PATENT DOCUMENTS

| | | | | | |
|---|---|---|---|---|---|
| 2,729,425 | A * | 1/1956 | Gschwind | 182/239 |
| 3,879,016 | A * | 4/1975 | Kankkunen | 242/396 |
| 4,493,396 | A * | 1/1985 | Borgia | 182/238 |
| 4,640,388 | A * | 2/1987 | Walborn | 182/231 |
| 4,877,110 | A | 10/1989 | Wolner | |
| 5,186,289 | A | 2/1993 | Wolner et al. | |
| 5,220,977 | A | 6/1993 | Wolner | |
| 5,351,906 | A * | 10/1994 | Feathers | 242/396.6 |
| 5,447,280 | A | 9/1995 | Feathers | |
| 5,711,404 | A * | 1/1998 | Lee | 188/164 |
| 5,730,407 | A | 3/1998 | Ostrobrod | |
| 5,771,993 | A | 6/1998 | Anderson et al. | |
| 6,695,095 | B1 | 2/2004 | Franke | |
| 6,745,872 | B2 * | 6/2004 | Sato | 182/238 |
| 6,799,738 | B2 * | 10/2004 | Sauder et al. | 242/381 |
| 6,804,830 | B2 | 10/2004 | Reynolds et al. | |
| 6,810,997 | B2 | 11/2004 | Schreiber et al. | |
| 6,962,235 | B2 * | 11/2005 | Leon | 182/73 |
| 6,964,319 | B2 | 11/2005 | Anderson | |
| 2005/0051659 | A1 | 3/2005 | Wolner et al. | |
| 2007/0151805 | A1 | 7/2007 | Betcher et al. | |
| 2007/0215410 | A1 | 9/2007 | Ecker | |
| 2009/0064400 | A1 | 3/2009 | Garrigos | |
| 2009/0084631 | A1 | 4/2009 | Casebolt | |
| 2009/0178887 | A1 | 7/2009 | Reeves et al. | |

FOREIGN PATENT DOCUMENTS

| | | | |
|---|---|---|---|
| EP | 1867244 | A1 | 12/2007 |
| WO | 2008008225 | A2 | 1/2008 |
| WO | 2010017084 | A1 | 2/2010 |

* cited by examiner

*Primary Examiner* — Colleen M Chavchavadze
(74) *Attorney, Agent, or Firm* — The Webb Law Firm

(57) ABSTRACT

A fall protection arrangement including a rotatable hub and a lifeline having a first end attached to the hub and a second end for removable attachment to a user, an engagement mechanism to prevent rotation of the hub upon activation, and a braking arrangement to brake the payout of the lifeline during a fall event.

19 Claims, 7 Drawing Sheets

FALL PROTECTION ARRANGEMENT

CROSS REFERENCE TO RELATED APPLICATIONS

This application claims the benefit of priority from Provisional Patent Application No. 61/333,984, filed May 12, 2010, the contents of which are incorporated herein in its entirety.

BACKGROUND OF THE INVENTION

1. Field of the Invention

The present invention relates generally to safety systems and arrangements and in particular to a fall protection arrangement, such as a controlled descent device, including self-retracting lanyards and the like, which may be used in connection with a harness to protect the wearer from a sudden, accelerated fall arrest event.

2. Description of the Related Art

As is known in the art of safety systems and processes, a lanyard, such as a self-retracting lanyard (SRL), are used for fall protection in both industrial environments, as well as in connection with recreational activities. Self-retracting lanyards have numerous industrial end uses, including, but not limited to, construction, manufacturing, hazardous materials/remediation, asbestos abatement, spray painting, sand blasting, welding, mining, numerous oil and gas industry applications, electric and utility, nuclear energy, paper and pulp, sanding, grinding, stage rigging, roofing, scaffolding, telecommunications, automotive repair and assembly, warehousing, and railroading. Some tend to be more end-use specific than others, like the building/construction system of U.S. Pat. No. 6,695,095 or the roof anchoring system of U.S. Pat. No. 5,730,407. One representative SRL is shown and described in U.S. Publication No. 2007/0215410, the disclosure of which is incorporated by reference herein.

Further, there exist numerous SRLs, or lifelines, in the field of fall protection and related safety equipment. They can and should be worn by an individual when there is any risk of falling. Such SRLs generally consist of a housing that includes a rotatable drum or hub around which a line, typically made of webbing, cable, rope, and/or synthetic material is wound. The hub rotates in a first direction to unwind (or "pay out") the line from its housing when a certain level of tension is purposefully applied. When that degree of tension is reduced or released, the hub can slowly rotate in a reverse direction causing the line to retract or rewind about itself in a desired manner. Certain housings further include a braking mechanism or assembly for resisting hub rotation when an inelastic line (e.g., a steel cable) unwinds too rapidly, i.e., faster than its predetermined maximum velocity for normal pay out. A sudden line pay out is an indication that the lanyard wearer/user has experienced a fall that needs to be stopped or arrested.

Should an unintentional, accidental fall commence, an engagement and braking arrangement in the housing of the SRL engages, which prevents the SRL wearer from falling too far. In addition, SRLs typically connect at one end to an anchorage point, often on the support structure at or near where a user is performing certain assigned tasks. The line from the SRL housing is clamped (or otherwise attached) to a harness worn by the worker. One representative harness is shown and described in U.S. Pat. No. 6,804,830, the disclosure of which is incorporated by reference herein. Other known models of SRLs include those disclosed in: U.S. Pat. Nos. 6,810,997; 5,186,289; 4,877,110; and U.S. Publication No. 2005/0051659.

Therefore, while many different models and arrangements of SRLs exist, one common problem that arises with the braking mechanism is the galling or uneven wear that occurs in connection with portions of the braking mechanism, such as the friction pads. This galling effect leads to variability in performance due to the variability in contact and pressure points between adjacent surfaces in the mechanism. Further, this increased variability may lead to product failure and reduced effectiveness in operation.

In addition, in the field of fall arrest devices, the maximum allowable stopping forces and distances are defined by known industry standards. The stopping force provided by a brake is inversely proportional to the stopping distance, i.e., the higher the force the shorter the distance, and vice versa. As a result, the force cannot exceed the maximum allowed by standards, and yet it must also be large enough so that the extension distance does not exceed the maximum also regulated by these standards. Accordingly, large force and extension variations (which result from galling and uneven wear) require designers to develop products with tight design limits to account for this variation. Therefore, a reduction in this variation allows for expanded design windows that are more easily achieved in the manufacturing process, which results in a product that is more robust and cost effective to manufacture.

Accordingly, there remains a need in the field for improved fall protection and arrest devices and systems that lead to enhanced safety characteristics and user protection in certain environments and situations.

SUMMARY OF THE INVENTION

Generally, the present invention provides a fall protection arrangement that addresses or overcomes some or all of the drawbacks and deficiencies associated with known devices and arrangements in the field of fall protection and worker safety. Preferably, the present invention provides a fall protection arrangement that reduces or eliminates the effects of galling or uneven wear in certain components of a fall protection device. Preferably, the present invention provides a fall protection arrangement that reduces variability in braking performance in a fall protection device. Preferably, the present invention provides a fall protection arrangement that meets regulatory standards in a reliable and cost effective manner.

Accordingly, and in one preferred and non-limiting embodiment, the present invention provides a fall protection arrangement. The fall protection arrangement includes a rotatable hub and a lifeline having a first end attached to the hub and a second end configured for removable attachment to a user. An engagement mechanism is configured or arranged to directly or indirectly prevent rotation of the hub upon activation; and a braking arrangement is configured to slow the rotation of the hub upon activation of the engagement mechanism The braking arrangement includes: (i) a brake hub having an annular flange and a shaft extending therefrom, the shaft including an outer contact surface; (ii) an engagement member adjustably engaged with the brake hub and configured to directly or indirectly clamp at least one friction washer and a brake plate between a contact surface of the engagement member and a contact surface of the annular flange of the brake hub, wherein the brake plate includes an inner circular cutout defining a contact edge; and (iii) a bearing positioned between the contact edge of the brake plate and the contact surface of the shaft of the brake hub.

In a further preferred and non-limiting embodiment, the present invention provides a fall protection arrangement including a rotatable hub and a lifeline having a first end attached to the hub and a second end configured for removable attachment to a user. An engagement mechanism is configured or arranged to directly or indirectly prevent rotation of the hub upon activation, and a braking mechanism is configured to slow the rotation of the hub upon activation of the engagement mechanism. The braking arrangement includes: (i) a brake hub having an annular flange and a shaft extending therefrom, the shaft including an outer contact surface; and (ii) an engagement member adjustably engaged with the brake hub and configured to directly or indirectly clamp at least one friction washer and a brake plate between a contact surface of the engagement member and a contact surface of the annular flange of the brake hub. The contact surface of the annular flange of the brake hub is tilted towards the shaft at a specified angle.

In a still further preferred and non-limiting embodiment, the present invention provides a fall protection arrangement including a rotatable hub and a lifeline having a first end attached to the hub and a second end configured for removable attachment to a user. The hub includes an outer surface around which the lifeline is wound, and the lifeline extends under a protrusion, such that a first portion of the lifeline extends from the first end of the lifeline to the protrusion, and a second portion extends from the protrusion to the second end of the lifeline. The protrusion is configured or arranged to retain the lifeline and, under certain conditions, fracture and release the first portion of the lifeline. An engagement mechanism is configured or arranged to directly or indirectly prevent rotation of the hub upon activation, and a braking arrangement is configured to slow the rotation of the hub upon activation of the engagement mechanism.

The methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural forms unless the context clearly dictates otherwise.

DETAILED DESCRIPTION OF THE PREFERRED EMBODIMENTS

Figure 1:
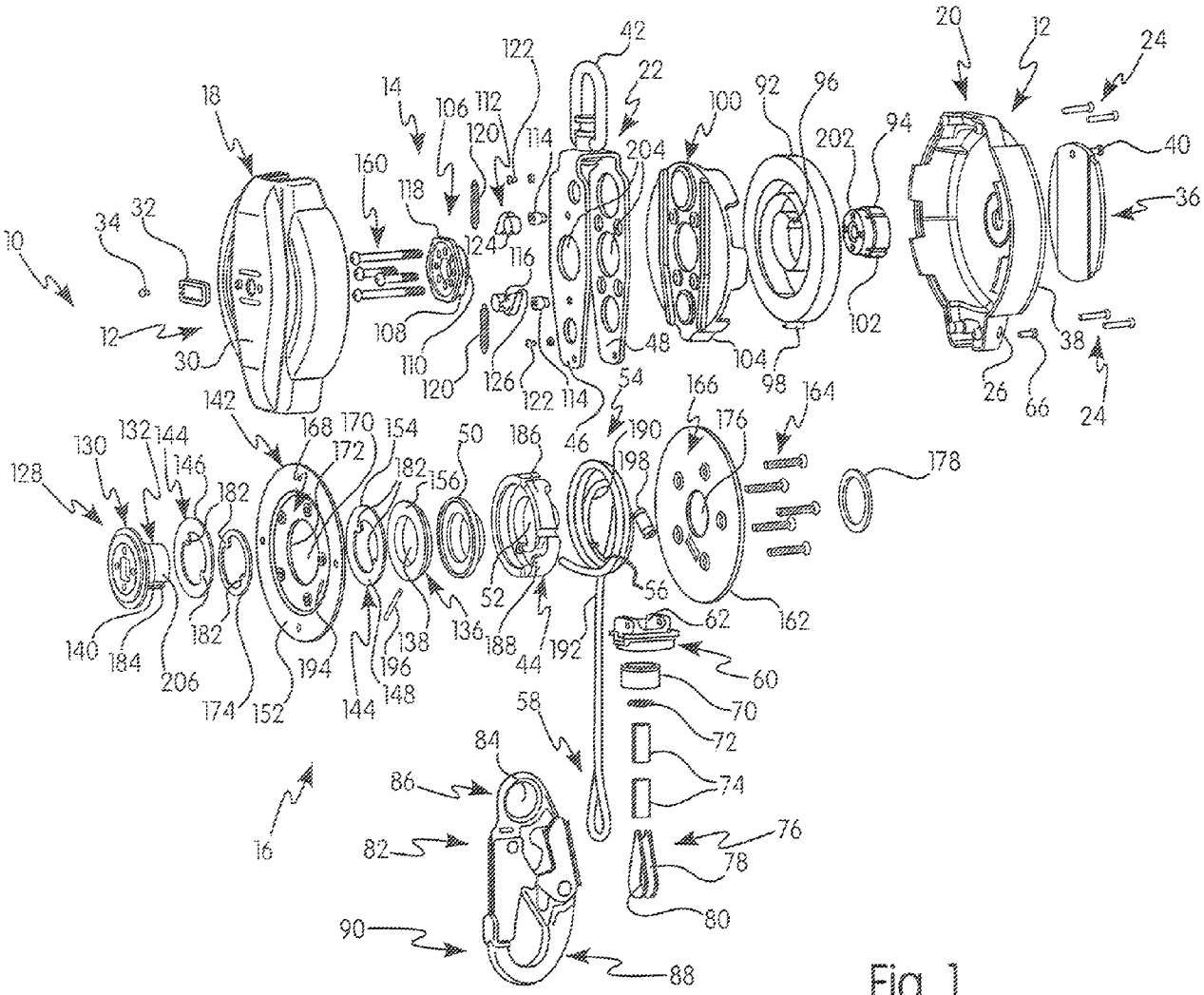
FIG. 1 is a first perspective, exploded view of a fall protection arrangement according to the principles of the present invention.
Figure 2:
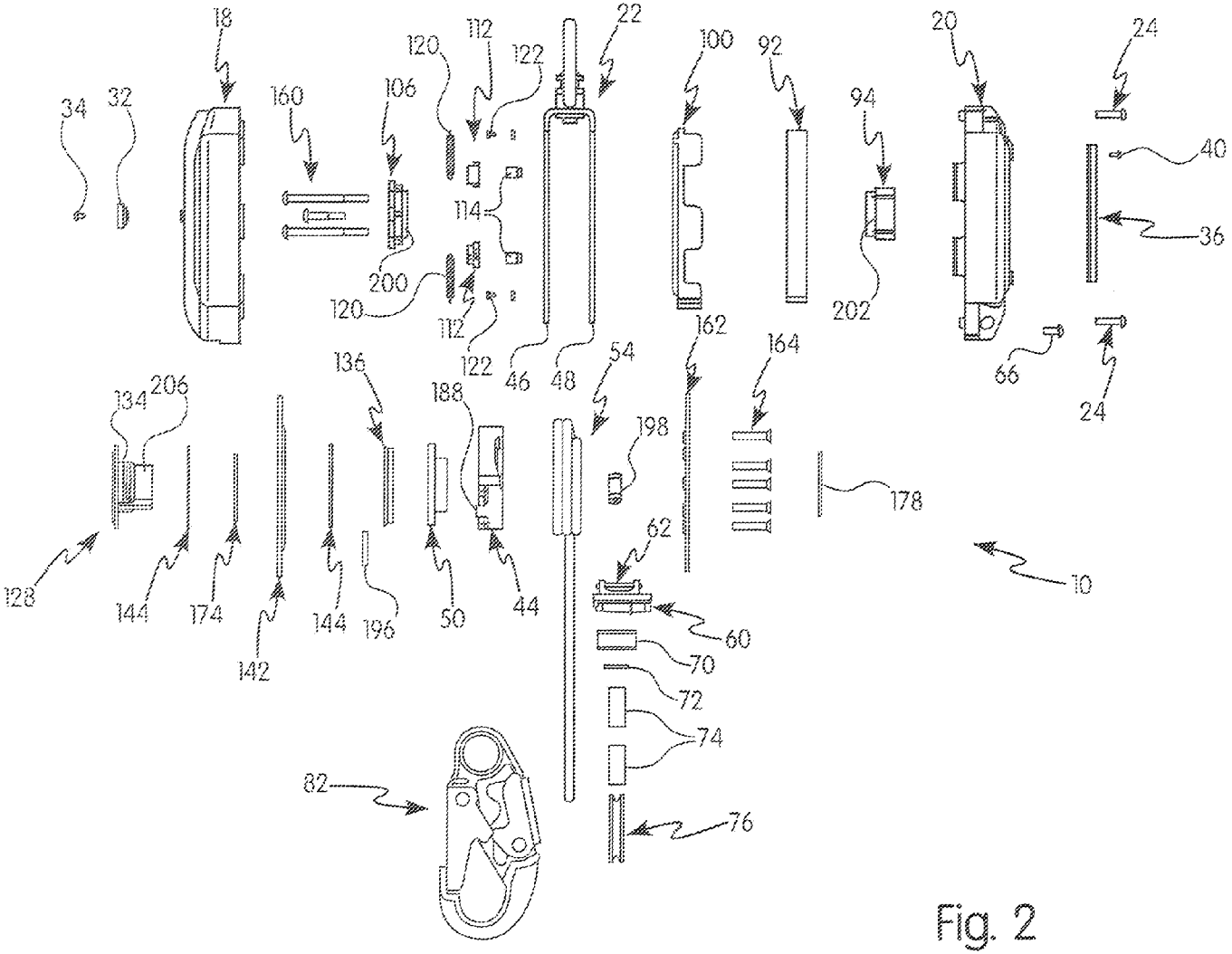
FIG. 2 is a side, exploded view of the fall protection arrangement of FIG. 1.
Figure 3:
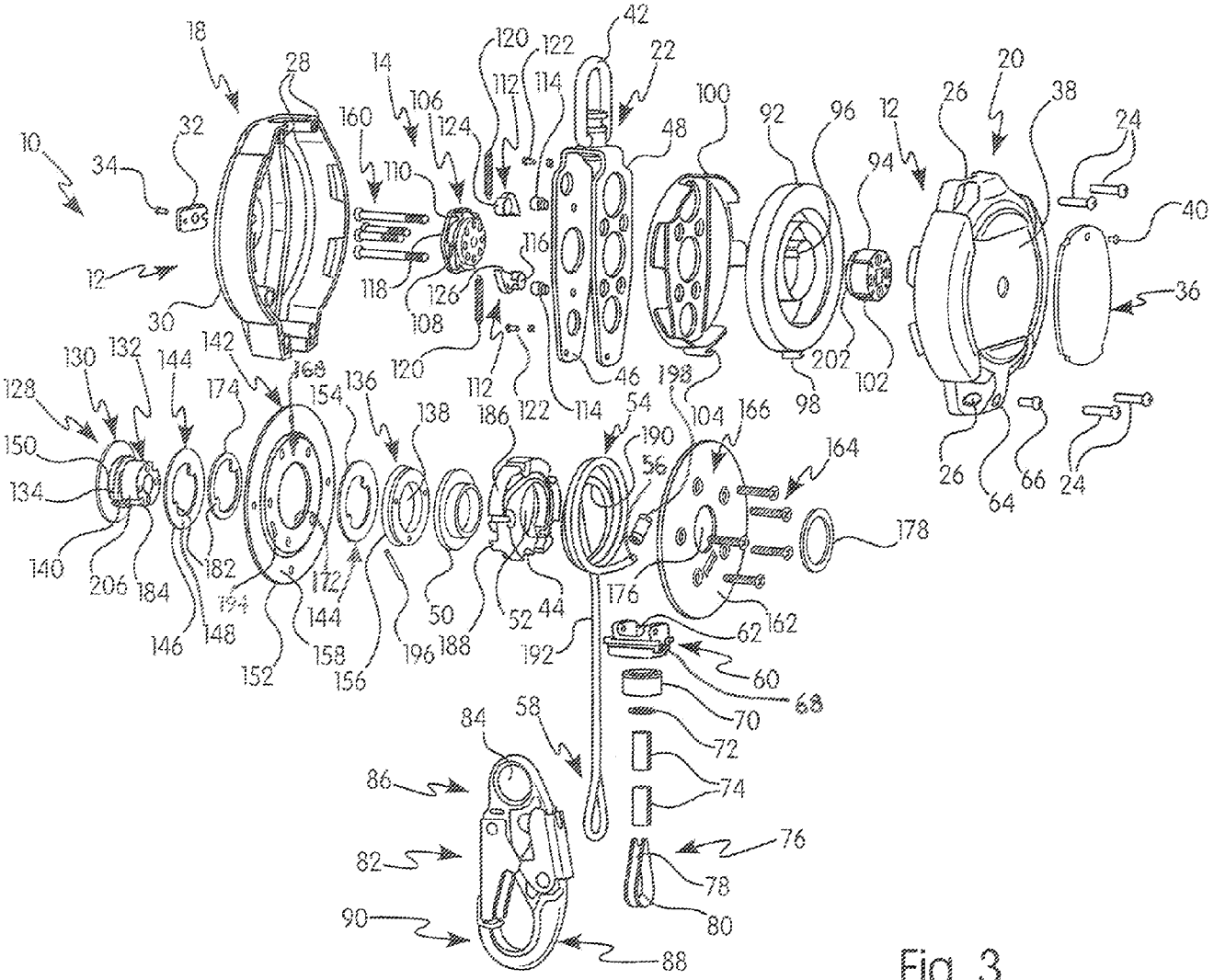
FIG. 3 is a second perspective, exploded view of the fall protection arrangement of FIG. 1.
Figure 4:
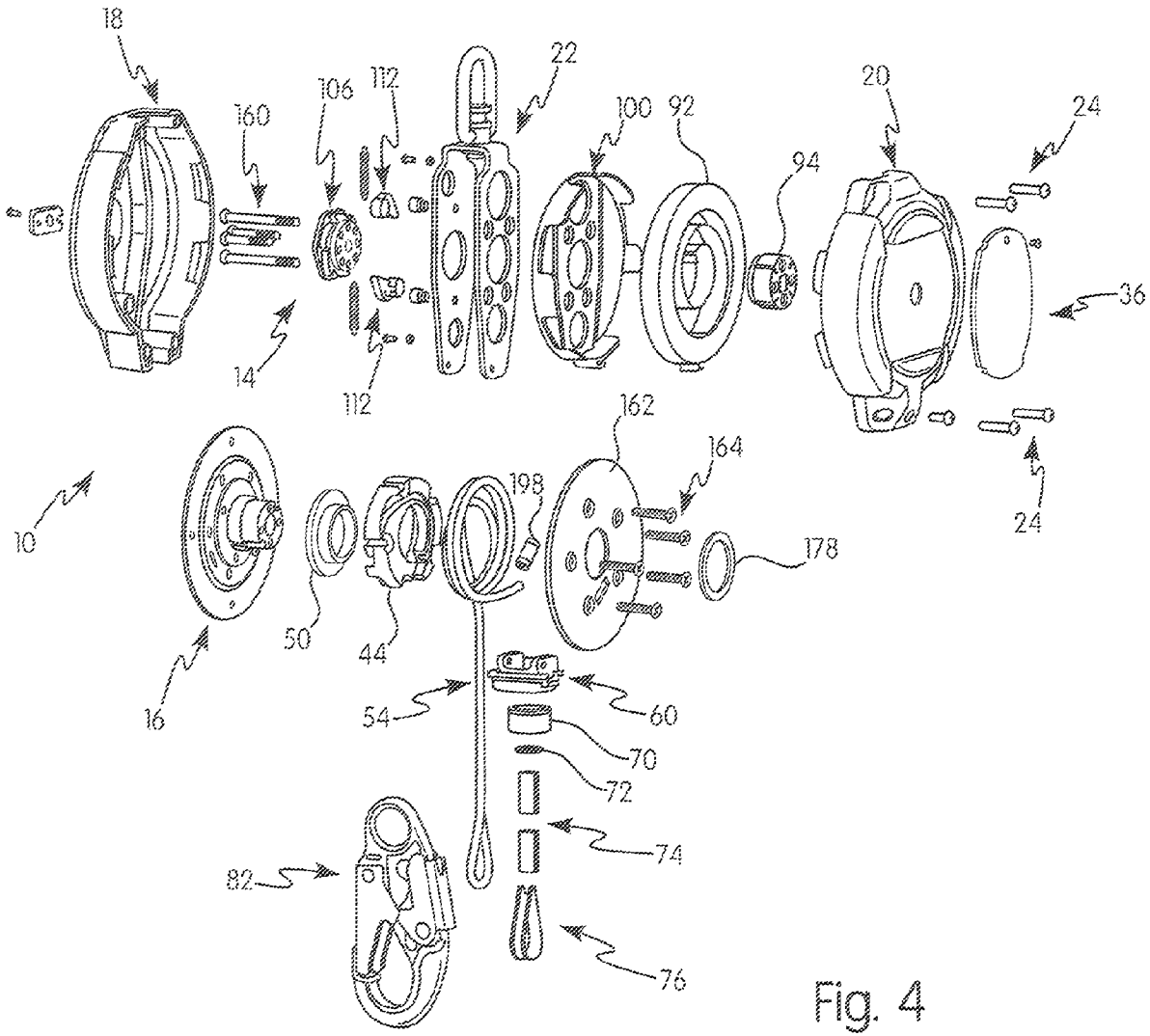
FIG. 4 is a first perspective, partially exploded view of a fall protection arrangement according to the principles of the present invention.
Figure 5:
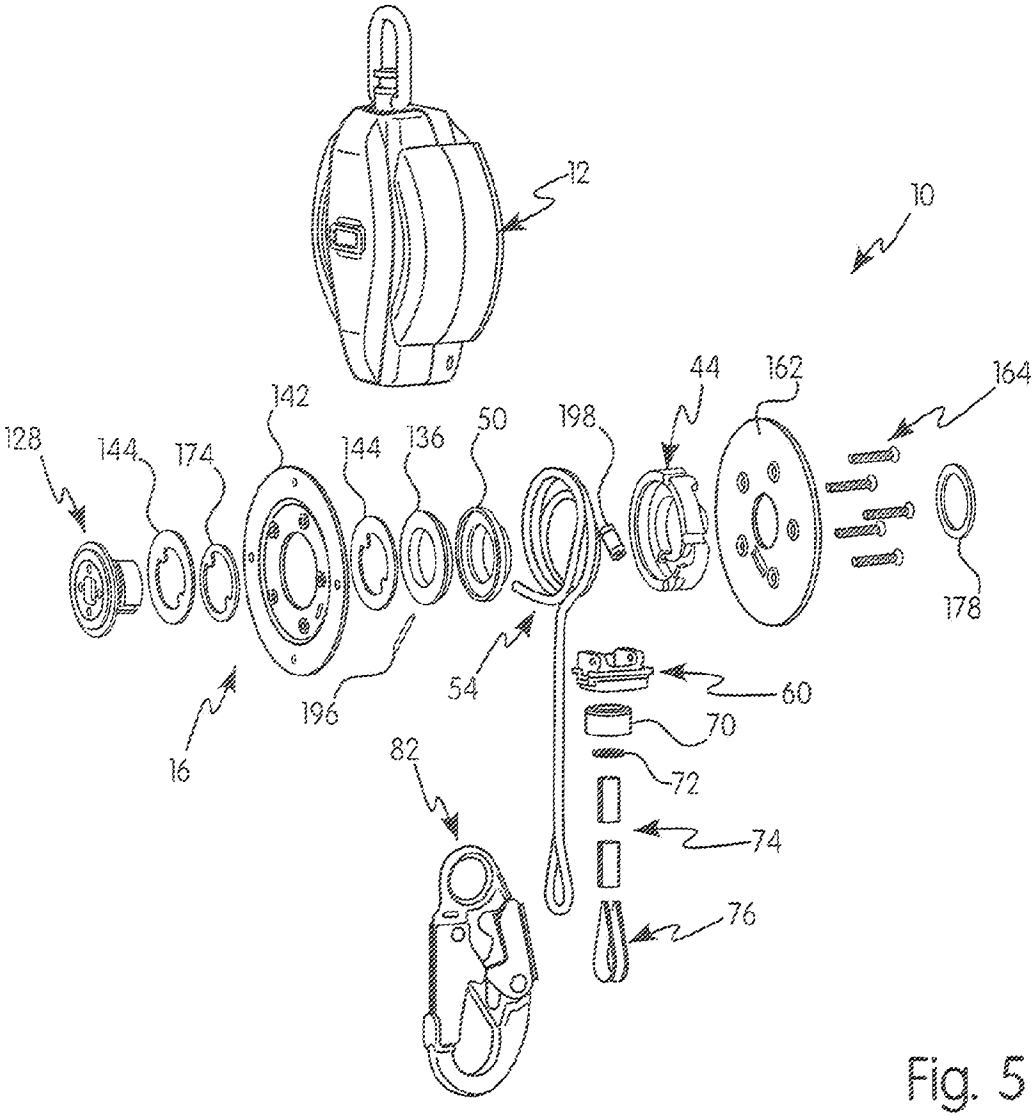
FIG. 5 is a first perspective, partially exploded view of a fall protection arrangement according to the principles of the present invention.
Figure 6:
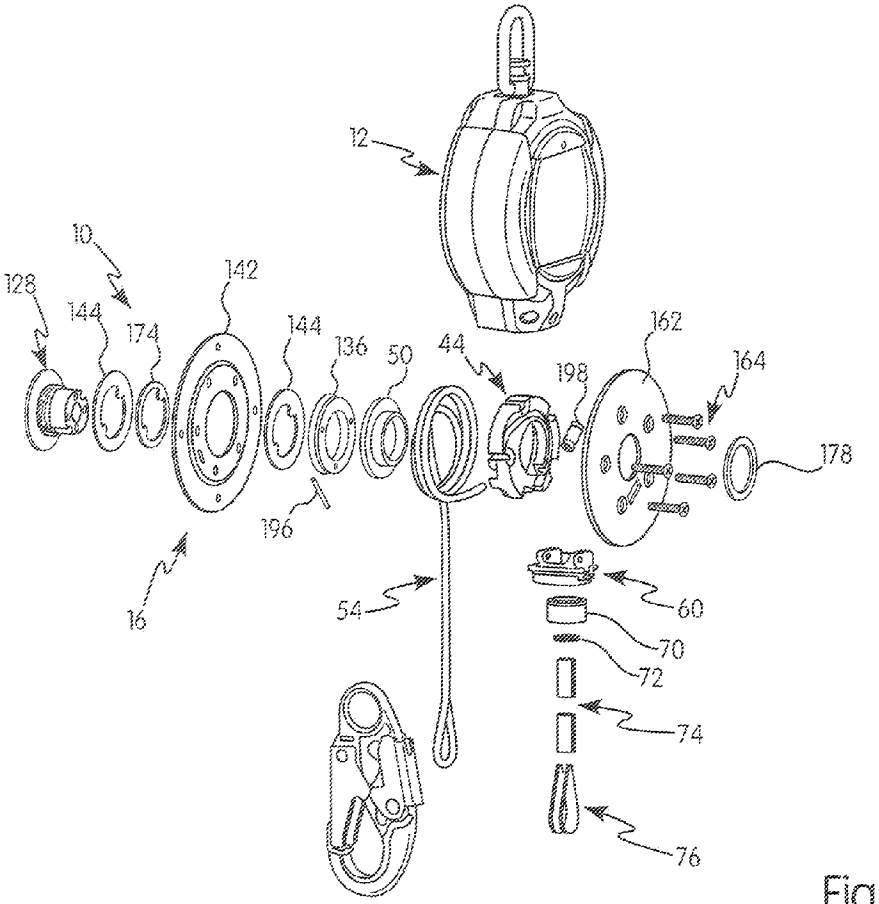
FIG. 6 is second perspective, partially exploded view of the fall protection arrangement of FIG. 5.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting. Further, it is to be understood that the invention may assume various alternative variations and step sequences, except where expressly specified to the contrary.

The present invention is directed to a fall protection arrangement 10 for use in industrial environments and recreational activities in order to provide appropriate fall protection functions and features to a user. The presently-invented fall protection arrangement 10 can be implemented in any appropriate application or environment where a user or worker engages in activities in an elevated position and requires some protection in the event of a fall. Further, in one preferred and non-limiting embodiment, the fall protection arrangement 10 of the present invention is in the form of a lanyard, such as a self-retracting lanyard. In addition, the fall protection arrangement 10, sometimes referred to as a lifeline, protects the user should an unintentional, accidental fall commence. In order to prevent the user from falling too far or stopping too quickly, the fall protection arrangement 10 includes some braking arrangement or mechanism.

Certain preferred and non-limiting embodiments of the fall protection arrangement 10 of the present invention are illustrated in FIGS. 1-7, and in an exploded or partially exploded view in FIGS. 1-6 for purposes of clarity. Accordingly, and in connection with the fall protection arrangement 10 illustrated in FIGS. 1-7, the arrangement 10 includes a housing 12 for at least partially surrounding various internal components of the fall protection arrangement 10, an engagement mechanism 14 for preventing rotation of certain components of the arrangement 10 in certain situations, and a braking arrangement 16 that is operable to slow the rotation of certain components of the arrangement 10 in the event of a sudden payout of line.

With respect to the housing 12, a first housing member 18 and a second housing member 20 are provided. In addition, the first housing member 18 and the second housing member 20 are removably connectable to each other and a frame 22. In particular, bolts 24 (or some other fastening mechanism or arrangement) are positionable through orifices 26 of the second housing member 20 and threadedly engageable in sleeves 28 of the first housing member 18. In this manner, the first housing member 18 and the second housing member 20 are clamped to and around the frame 22 and serve to cover various internal components of the fall protection arrangement 10.

On an outer surface 30 of first housing member 18, an indicia member 32 can be attached using screw 34. Further, one or more tags 36 can be connected to an outer surface 38 of the second housing member 20 using a screw 40. These tags 36 (or labels) may include information in a variety of languages for informing the user regarding various structural and operational features associated with the fall protection arrangement 10.

The frame 22 is a generally elongated member with multiple openings and serves as the central structural point of the fall protection arrangement 10 to which most of the various components are directly or indirectly attached. On one end of the frame 22, an attaching loop 42 is connected. This attaching loop 42 is rotatable and configured for attachment to some secure anchorage point, cable, or other structure that serves as the central connection point between the fall protection arrangement 10 and a secure structure.

Within the housing 12, a hub 44 is rotatably attached within a substantially central portion of the frame 22, specifically between a first aim 46 of the frame 22 and a second arm 48 of the frame 22. A bearing 50 is positionable on and at least partially through a central opening 52 of the hub 44. In addition, a lifeline 54 having a first end 56 attached to a component in the braking arrangement 16 through the hub 44 (and screws 164) and a second end 58 with the appropriate components to be removably attachable to a user. A terminal 198 may also be positioned on or clamped to the first end 56 of the lifeline 54 for engagement with a portion of the hub 44.

In order to facilitate appropriate rotation of the hub 44 with respect to the frame 22, a bearing portion 200 is located on a rotatable sperrad 106, and a bearing portion 202 is located on a spring hub 94. These bearing portions 200 and 202 or surfaces extend at least partially through a respective opening 204 on a respective aim 46 and 48 of the frame 22. The rotation of the hub 44 and interaction with other components of the braking arrangement 16 is further facilitated through the use of a brake hub 128 and the above-mentioned bearing 50, where an outer surface 206 of the brake hub interacts with the bearing 50. With respect to FIGS. 1-6, all of the components at the lower part of these figures (starting with the brake hub 128 and ending with a spacer hub 178) are positioned between the arms 46 and 48, while the sperrad 106 and the spring hub 94 are located on the outside of the arms 46 and 48.

The second end 58 of the lifeline 54 extends out of the housing 12 through a nozzle 60, and specifically through an opening 62 extending through the nozzle 60. The nozzle 60 is removably attachable to a lower portion of the housing 12 with an orifice 64 extending therethrough. In particular, a screw 66 is attached through the orifice 64 in the housing 12 and mates with a threaded orifice 68 on the nozzle 60. The second end 58 of the lifeline 54 further extends through a bumper 70 that protects the lower portion of the housing 12 and nozzle 60 from contact, and further through a washer 72. In addition, the second end 58 of lifeline 54 extends through a plurality of ferrules 74 around a thimble 76 (having a "teardrop" shape) and along a path 78, and back through the ferrules 74. The thimble 76 also includes a central opening 80.

A connector 82 is attached through the central opening 80 of the thimble 76 by using an opening 84 positioned at an upper portion 86 of the connector 82. An engageable hook member 88 is formed or structured at a lower portion 90 of the connector 82. This hook member 88 is used to removably attach the fall protection arrangement 10 to a user, normally through the use of a D-ring (not shown) attached to a portion of the user's safety gear.

In operation, the lifeline 54 is configured to be wound and unwound from the hub 44 and through the nozzle 60. In one preferred and non-limiting embodiment, the fall protection arrangement 10 is in the form of a self-retracting device, such that the lifeline 54 will mechanically retract within the housing 12 and back around the hub 44. This is accomplished through the use of a spring 92, which is attached to the spring hub 94 at a first end 96 of the spring 92. The spring hub 94 is attached to the sperrad 106 through the use of screws 160, while the hub 44 is operatively engaged to a component of the braking arrangement 16 through the use of screws 164. Further, the second end 98 of the spring 92 is attached to a plate 100 rigidly attached to the second arm 48 of the frame 22.

In this manner, when the lifeline 54 is extracted from the housing 12, and based upon the interaction between the hub 44 and spring hub 94, the spring 92 is wound tighter around the spring hub 94. This potential energy is released and the spring 92 unwinds when tension is released on the lifeline 54, such that the lifeline 54 extends back into the housing 12 through the nozzle 60 and around the hub 44. The first end 96 of the spring 92 is attached or clamped in a slot 102 of the spring hub 94, while the second end 98 of the spring 92 is clamped or otherwise engaged with a slot 104 on the plate 100. Such a function ensures that excess lifeline 54 does not droop, tangle, or otherwise causing safety issues as the user is moving their position.

With continued reference to FIGS. 1-6, and in one preferred and non-limiting embodiment, the engagement mechanism 14 includes the rotatable sperrad 106, which includes multiple teeth 108, with at least one root 110 defined between adjacent teeth 108. Based upon the attachment provided by the screws 160, the sperrad 106 is configured to rotate as the hub 44 rotates. At least one pawl 112 is pivotably connected to the frame 22 via a shaft 114 extending through a central opening 116 of each pawl 112. Each shaft 114 is attached to the frame 22 and permits pivoting of the pawl 112. In addition, each pawl 112 is urged into a contact position with a guide path 118 on the sperrad 106 using a respective spring 120. Each spring 120 is sized and shaped so as to urge continual contact with the guide path 118 of the sperrad 106, and further, each spring 120 is rigidly attached to the frame 22 through the use of a screw 122.

In operation, as the sperrad 106 rotates and a contact portion 124 of the pawl 112 moves along the guide path 118, continued rotation of the sperrad 106 and, thus, the hub 44 is permitted. However, if the speed of the rotation of the sperrad 106 reaches a certain level, the interaction between portions of the guide path 118 and the contact portion 124 of the pawl 112 causes a tip 126 of at least one of the pawls 112 to move into and engage in a respective root 110 between the teeth 108 of the sperrad 106. This, in turn, causes immediate prevention of rotation of the sperrad 106, and thus, the hub 44. Based upon the geometry and interaction of the components of the engagement mechanism 14, the cessation of rotation of the sperrad 106 and hub 44 occurs at a known range of rotation speed that is indicative of a fall event.

As discussed above, in the event of a fall, further rotation of the hub 44 is prevented through the engagement mechanism 14 (and the interaction with the brake hub 128 of the braking arrangement 16). However, additional lifeline 54 will continue to extend from the housing 12 based upon the forces of the fall and the weight of the user attached to the connector 82 through the use of the braking arrangement 16. In particular, and as discussed above, a sudden prevention of rotation would exert unsafe forces on the user, possibly causing bodily harm. Therefore, the braking arrangement 16 is used to ensure a more gradual slowing process, thereby reducing the fall forces exerted on the user.

In one preferred and non-limiting embodiment, and again with reference to FIGS. 1-7, the braking arrangement 16 includes the brake hub 128 having an annular flange 130 and a shaft 132 extending from this annular flange 130. The bearing 50 at least partially facilitates rotation of the hub 44 around the outer surface 206 of the shaft 132 of the brake hub 128. Accordingly, the shaft 132 includes an outer contact surface that fits within and facilitates the rotation of the bearing 50. In addition, and in this embodiment, an engagement member, such as a nut 136, is adjustably engageable with the brake hub 128, such as through threaded engagement between walls defining a central opening 138 of the nut 136 and a thread path 140 disposed on a surface of the shaft 132. In this manner, the nut 136 can be threadedly moved toward and away from the annular flange 130. Any adjustably engageable element or arrangement may be used in replacement of the nut 136.

In a further preferred and non-limiting embodiment, the threaded engagement between the nut 136 and thread path 140 on the shaft 132 of the brake hub 128 is a left-handed thread, such that in operation, and based upon the direction of rotation of the hub 44, the nut 136 will be continually urged (if at all) into a tightened position with respect to the brake hub 128. In addition, a locking pin 196 can be inserted through an opening of the nut 136 and brake hub 128, thus further ensuring that the various components of the braking arrangement 16 do not rotate during the braking operation.

The nut 136 is configured to clamp a circular brake plate 142 between two friction washers 144. In particular, a first friction washer 146 having a friction surface 148 is clamped between a contact surface 150 of the annular flange 130 and a first side 152 of the brake plate 142, such that the friction surface 148 at least partially contacts the first side 152 of the brake plate 142. Similarly, a second friction washer 154 (also having a friction surface 148) is clamped between a contact surface 156 of the nut 136 and a second side 158 of the brake plate 142, again with the friction surface 148 contacting the second side 158 of the brake plate 142.

In operation, the sperrad 106 is rigidly attached to the brake hub 128 using one or more screws 160, such that when the sperrad 106 stops rotating and the brake hub 128 likewise stops rotating, the brake plate 142 continues to rotate more and more slowly based upon the contact and friction between the friction washers 144 and the brake plate 142. Further, the hub 44 is attached between the brake plate 142 and a side plate 162, so that the brake plate 142, hub 44, and side plate 162 all rotate in unison. The attachment between these components can be effected using screws 164 extending through respective orifices 166 in the side plate 162 and orifices 168 in the brake plate 142.

Additionally, the side plate 162 includes a central opening 176 through which the shaft 132 of the brake hub 128 extends. A spacer hub 178 is provided and positioned between the side plate 162 and second arm 48 of the frame 22. This arrangement allows for the functional rotation of the hub 44 around which the lifeline 54 is wound.

In one preferred and non-limiting embodiment, the brake plate 142 includes a central opening 170 defining a contact edge 172. A bearing 174 is positioned between the contact edge 172 of the brake plate 142 and a contact surface 134 of the shaft 132. This allows for appropriate spacing and uniform rotation of the brake plate 142 around the brake hub 128. Such proper alignment, in turn, leads to more uniform contact between the friction washers 144 and the sides of the brake plate 142. In addition, such uniformity reduces variation and leads to even wear of the friction washers 144 and/or the brake plate 142, thereby minimizing or preventing galling or other negative effects. Further, bearing 174 prevents galling or other negative effects between contact edge 172 of the brake plate 142 and the contact surface 134 of the brake hub 132.

Figure 7:
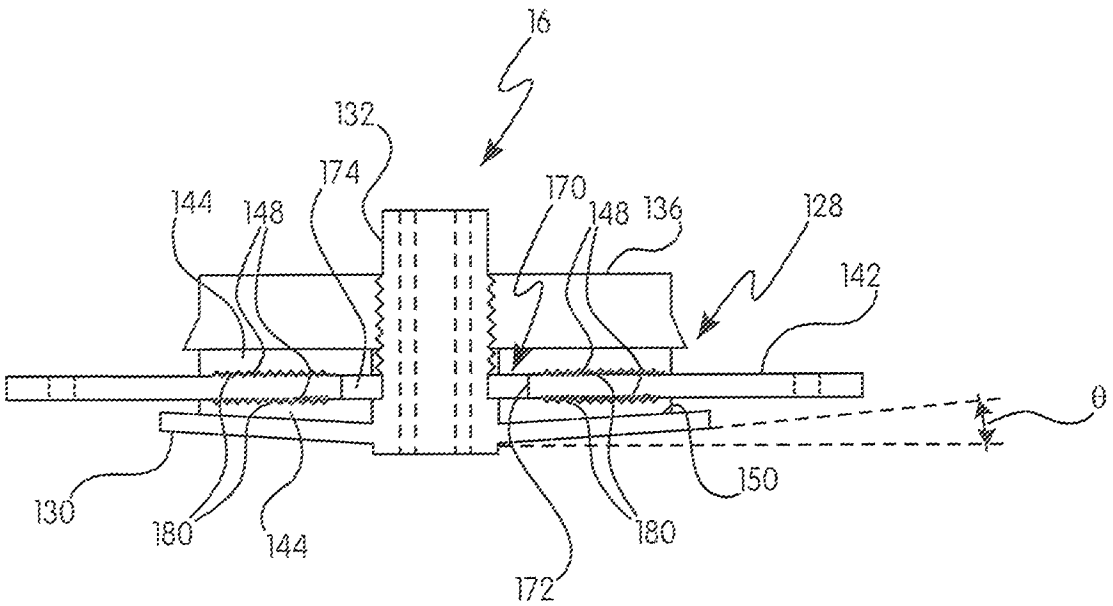
FIG. 7 is a cross sectional view of a fall protection arrangement according to the principles of the present invention.

In one preferred and non-limiting embodiment, and as illustrated in FIG. 7, the bearing 174 is manufactured from a polymer material, and in another preferred, and non-limiting embodiment, at least a portion of the brake plate 142 comprises a hard-coated anodized material. In a still further preferred and non-limiting embodiment, the brake plate 142 is manufactured from a hard-coated anodized aluminum material. Therefore, the contact edge 172 of the central opening 170 of the brake plate 142 extends adjacent the polymer bearing 174. Still further, the friction washers 144 (and, in particular, the contact friction surfaces 148 thereof) are manufactured from a steel material finished to a specified surface roughness and lubricity. In this embodiment, the interaction between the polymer bearing 174, the hard-coat anodized brake plate 142, and the steel friction washers 144 and brake hub 128 lead to a structure that minimizes or prevents galling between these various components.

As is known, galling results in unpredictability in the braking friction of the fall protection arrangement 10, since it is the torques generated through the rotational friction between the brake plate 142 and the friction washers 144 that provides the braking to reduce the forces experienced by the user in a fall event. Accordingly, by using the structure according to the present invention, and as illustrated in FIG. 7, frictional interfaces 180 are limited to the two locations (one on either side of the brake plate 142). In this manner, variability in energy dissipation is reduced. In operation, the clamping force between the components in the braking arrangement 16 and the coefficient of friction between the friction washers 144 and the brake plate 142 provides the necessary frictional braking to reduce the fall forces experienced by the user.

In a still further preferred and non-limiting embodiment, and as illustrated in FIGS. 1-6, the friction washers 144 and the bearing 174 include mutually opposing tab projections 182 that are sized and shaped so as to slide along corresponding mutually opposing grooves 184 extending along the shaft 132 of the brake hub 128. By using these tab projections 182 and grooves 184, the friction washers 144 and bearing 174 are all prevented from rotating with the brake plate 142. Accordingly, these tab projections 182 and mating grooves 184 prevent rotation between friction washers 144, the annular flange 130, and the nut 136, thereby reducing the sliding surfaces to the frictional interfaces 180 between the friction washers 144 and the brake plate 142. As discussed, this reduces variability and allows for better predictability.

With reference to FIG. 7, and in another preferred and non-limiting embodiment, the contact surface 150 of the annular flange 130 is tilted towards the shaft 132 at a specified angle $\theta$. In one embodiment, this tilt or angle $\theta$ is between about 0.1 degrees and about 5 degrees. When the nut 136 is tightened, pressure is indirectly applied to the annular flange 130. The pressure causes the flange angle to deflect to about 0° when a predetermined slip torque is achieved between the friction washers 144 and the plate 142. This results in the planar contact of certain components of the braking arrangement 16, which provides uniform pressure across the friction interfaces 180. This, in turn, reduces variability and wear.

In a further preferred and non-limiting embodiment, the hub 44 includes an outer surface 186 around which the lifeline 54 is wound. In this embodiment, the lifeline 54 extends under a protrusion 188, such that a first portion 190 of the lifeline 54 extends from the first end 56 of the lifeline 54 to the protrusion 188, and a second portion 192 of the lifeline 54 extends from the protrusion 188 to the second end 58 of the lifeline 54. In this embodiment, the first portion 190 of the lifeline 54 would be considered the "reserve" lifeline to ensure that the lifeline 54 can pay out in all fall events regardless of how much lifeline 54 is extended prior to the event.

The protrusion 188 is sized and shaped so as to retain the lifeline 54 during normal operation, and fracture under specific conditions, thus releasing the first portion 190 of the lifeline 54 for further payout. The protrusion 188 extends at least partially through an opening 194 on the brake plate 142. This first portion 190 of the lifeline 54 has a predetermined length. Accordingly, the reserve (or first) portion 190 of the lifeline 54 ensures that there is sufficient line length to pay out in all fall events, and the engagement mechanism 14 and braking arrangement 16 can operate effectively.

As discussed above, the fracturing of the protrusion 188 only occurs at a predetermined force, which is induced when a wearer or user falls with most of the lifeline 54 deployed. Again, such an arrangement assures that there will always be enough line 54 for the engagement mechanism 14 and braking arrangement 16 to operate effectively, even when all of the second portion 192 of the lifeline 54 is deployed. Without such an arrangement, i.e., no reserve lifeline available for braking, a user may experience the above-discussed abrupt stop in a fall event, which could cause serious injury. Since the protrusion 188 is integral with the hub 44, the determination of the forces that should cause rupture or breaking is simpler and less prone to error. In addition, such an integral manufacture of the hub 44 with a protrusion 188 is more efficient and would not require some separate component, such as an additional pin or the like.

In this manner, the present invention provides a fall protection arrangement 10 that addresses many of the drawbacks and deficiencies evident in the existing field. The fall protection arrangement 10 of the present invention reduces variability in performance during the braking operation by providing consistently uniform sliding or friction surfaces that do not gall or wear in an uneven manner. As discussed, the bearing 174 minimizes or eliminates galling between the brake plate 142 and the brake hub 128, and the material of construction and surface finishes of the brake plate 142 and the friction washers 144 minimize or eliminate galling during braking, while also providing enough torsional resistance to arrest a falling user.

By using the angled annular flange 130, upon clamping with the nut 136, the annular flange 130 deflects to a flat surface against the first friction washer 146, thereby providing uniform pressure on the friction washer 146 and the brake plate 142. In addition, the tab projections 182 on the friction washers 144 serve to "key" to the shaft 132 of the brake hub 128, and prevent rotation of the friction washers 144, such that the frictional interfaces 180 are known and limited.

Still further, reduced variability increases the robustness and cost effectiveness of the fall protection arrangement 10 of the present invention. For example, by reducing variation, larger design windows are easily achieved in the manufacturing process. In addition, the manufacturing process is further simplified through the use of the above-discussed protrusion 188. Accordingly, the fall protection arrangement 10 of the present invention minimizes or eliminates galling, maintains the concentricity of the various components, provides uniform braking, and results in the optimization of the mechanical interactions between the components during operation.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A fall protection arrangement, comprising:

a rotatable hub and a lifeline having a first end attached to the hub and a second end configured for removable attachment to a user;

an engagement mechanism configured to directly or indirectly prevent rotation of the hub upon activation; and a braking arrangement configured to slow the rotation of the hub upon activation of the engagement mechanism, the braking arrangement comprising:

(i) a brake hub having an annular flange and a shaft extending therefrom, the shaft including an outer contact surface;

(ii) a brake plate having an inner central opening defining a contact edge;

(iii) an engagement member adjustably engaged with the brake hub to clamp, via frictional contact, a first friction washer on a first side of the brake plate to the brake plate and to a contact surface of the engagement member and to clamp a second friction washer on a second side of the brake plate to the brake plate and to a contact surface of the annular flange of the brake hub; and (iv) a bearing positioned between the contact edge of the brake plate and the contact surface of the shaft of the brake hub, wherein the contact surface of the annular flange of the brake hub is tilted towards the shaft at a specified angle.

2. The arrangement of claim 1, wherein at least a portion of the bearing is manufactured from a polymer material.

3. The arrangement of claim 1, wherein at least a portion of the brake plate comprises a hard-coated anodized material.

4. The arrangement of claim 3, wherein at least a portion of the brake plate is manufactured from an aluminum material.

5. The arrangement of claim 1, wherein at least one of the first friction washer and the second friction washer are manufactured from a steel material finished to a specified surface roughness and lubricity.

6. The arrangement of claim 1, wherein at least one of the first friction washer, the second friction washer, and the bearing further include at least one tab projection configured to slide along a corresponding at least one groove extending at least partially along the shaft of the brake hub.

7. The arrangement of claim 6, wherein at least one of the first friction washer, the second friction washer, and the bearing include two mutually opposing tab projections configured to slide along corresponding mutually opposing grooves extending at least partially along the shaft of the brake hub.

8. The arrangement of claim 1, wherein the angle is between 0.1° and 5°.

9. The arrangement of claim 1, wherein the engagement mechanism includes:

a rotatable sperrad having a plurality of teeth with at least one root defined between adjacent teeth, the sperrad configured to rotate with the hub; and at least one pawl pivotally connected to the frame, wherein, based upon the speed of rotation of the sperrad, the at least one pawl is contacted and moves into the at least one root, thereby preventing rotation of the sperrad and the hub.

10. The arrangement of claim 1, wherein the rotatable hub includes an outer surface around which the lifeline is wound; wherein the lifeline extends under a protrusion, such that a first portion of the lifeline extends from the first end of the lifeline to the protrusion, and a second portion extends from the protrusion to the second end of the lifeline;

wherein the protrusion is configured to retain the lifeline and wherein the protrusion is configured to fracture under specific conditions to release the first portion of the lifeline.

11. The arrangement of claim 10, wherein the protrusion extends at least partially through an opening on the brake plate.

12. The arrangement of claim 10, wherein the first portion of the lifeline comprises an emergency lifeline portion having a specified length.

13. A fall protection arrangement, comprising:

a rotatable hub and a lifeline having a first end attached to the hub and a second end configured for removable attachment to a user;

an engagement mechanism configured to directly or indirectly prevent rotation of the hub upon activation; and a braking arrangement configured to slow the rotation of the hub upon activation of the engagement mechanism, the braking arrangement comprising:

(i) a brake hub having an annular flange and a shaft extending therefrom, the shaft including an outer contact surface;

(ii) a brake plate having an inner central opening defining a contact edge;

(iii) an engagement member adjustably engaged with the brake hub to clamp, via frictional contact, a first friction washer on a first side of the brake plate to the brake plate and to a contact surface of the engagement member and to clamp a second friction washer on a second side of the brake plate to the brake plate and to a contact surface of the annular flange of the brake hub;

(iv) a bearing positioned between the contact edge of the brake plate and the contact surface of the shaft of the brake hub;

wherein the rotatable hub includes an outer surface around which the lifeline is wound; wherein the lifeline extends under a protrusion, such that a first portion of the lifeline extends from the first end of the lifeline to the protrusion, and a second portion extends from the protrusion to the second end of the lifeline; wherein the protrusion is configured to retain the lifeline and wherein the protrusion is configured to fracture under specific conditions to release the first portion of the lifeline, and wherein the contact surface of the annular flange of the brake hub is tilted towards the shaft at a specified angle.

14. The arrangement of claim 13, wherein the protrusion extends at least partially through an opening on the brake plate.

15. The arrangement of claim 13, wherein the first portion of the lifeline comprises and emergency lifeline portion having a specified length.

16. A fall protection arrangement, comprising:

a rotatable hub and a lifeline having a first end attached to the hub and a second end configured for removable attachment to a user;

an engagement mechanism configured to directly or indirectly prevent rotation of the hub upon activation; and a braking arrangement configured to slow the rotation of the hub upon activation of the engagement mechanism, the braking arrangement comprising:

(i) a brake hub having an annular flange and a shaft extending therefrom, the shaft including an outer contact surface;

(ii) a brake plate; and (iii) an engagement member adjustably engaged with the brake hub to clamp, via frictional contact, a first friction washer on a first side of the brake plate to the brake plate and to a contact surface of the engagement member and to clamp a second friction washer on a second side of the brake plate to the brake plate and to a contact surface of the annular flange of the brake hub;

wherein the contact surface of the annular flange of the brake hub is tilted towards the shaft at a specified angle;

wherein the brake plate includes an inner circular cutout defining a contact edge, the arrangement further comprising a bearing positioned between the contact edge of the brake plate and the contact surface of the shaft of the brake hub, wherein the bearing includes at least one tab projection configured to slide along a corresponding at least one groove extending at least partially along the shaft of the brake hub.

17. The arrangement of claim 16, further comprising a first friction washer positioned adjacent a first side of the brake plate, and a second friction washer positioned adjacent a second side of the brake plate, wherein each friction washer includes at least one tab projection configured to slide along a corresponding at least one groove extending at least partially along the shaft of the brake hub.

18. The arrangement of claim 16, wherein at least a portion of the brake plate comprises a hard-coated anodized material.

19. The arrangement of claim 16, wherein the angle is between 0.1° and 5°.

* * * * *